United States Patent [19]

Marra

[11] Patent Number: 4,691,439

[45] Date of Patent: Sep. 8, 1987

[54] POWERED ROOF SHINGLE DETACHER AND STRIPPER APPARATUS

[76] Inventor: Gerardo J. Marra, P.O. Box 836, River Edge, N.J. 07410-0836

[21] Appl. No.: 929,072

[22] Filed: Nov. 3, 1986

[51] Int. Cl.[4] ..... B26B 3/00

[52] U.S. Cl. ..... 30/170; 15/236 R; 30/171; 299/36; 299/37

[58] Field of Search ..... 30/169-172; 299/37, 39, 56; 15/236 R, 93 R, 93 C; 254/131.5; 294/53-55; 173/169

[56] References Cited

U.S. PATENT DOCUMENTS

| | | | |
|---|---|---|---|
| 1,535,411 | 4/1925 | Hanser | 299/37 X |
| 2,137,842 | 11/1938 | Jackson | 299/37 X |
| 2,465,192 | 3/1949 | Booth | 30/170 X |
| 3,959,900 | 6/1976 | Luck | 299/37 X |
| 4,086,699 | 5/1978 | Olkkola | 30/172 |
| 4,203,210 | 5/1980 | Hadlick | 30/172 |
| 4,219,238 | 8/1980 | Sanchez | 299/39 |
| 4,232,906 | 11/1980 | Torbenson | 299/39 |
| 4,269,450 | 5/1981 | Welborn | 299/39 |
| 4,277,104 | 7/1981 | Sanchez | 299/37 |
| 4,477,972 | 10/1984 | Testa | 30/172 |

FOREIGN PATENT DOCUMENTS

| | | | |
|---|---|---|---|
| 953182 | 12/1949 | France | 30/170 |

*Primary Examiner*—Douglas D. Watts
*Attorney, Agent, or Firm*—Frederick I. Levine

[57] ABSTRACT

My invention comprises a powered apparatus for detaching and stripping shingles from a building roof and may be used in any direction. A shovel-like device with a blade with nail body engagement slots at the front end and powered means to lower and raise the blade is mounted on a frame. When the blade is in the lowered position, it is moved under the shingles. Then the blade is raised to exert leverage and to detach the shingles while the slots in the blade engage nail bodies, press upward against the nail heads and pull out the nails. As the apparatus is rocked in a forward direction, the shingles, with the nails attached, are stripped by the blade and pushed off the roof or stacked in a pile. My invention can be operated by unskilled personnel in any bodily position and makes a slow, difficult and tiresome job easy by exerting substantial leverage sufficient to remove many layers of shingles. It satisfies a long felt need for a safe, lightweight, durable and reliable apparatus which will pay for itself in labor savings and increased efficiency. It is compact, portable and simple to maintain and repair. My invention is economical to produce and market. It has many other uses comprising, but not limited to, applications where prying and lifting is necessary on flat or sloping surfaces.

9 Claims, 9 Drawing Figures

POWERED ROOF SHINGLE DETACHER AND STRIPPER APPARATUS

BACKGROUND OF THE INVENTION

To secure protection of the roofs of buildings from the weather, shingles fabricated from asphalt, wood, or a diversity of other materials are used. Since these deteriorate with age and allow leakage, they must periodically be replaced. It is usual practice to detach and strip away the old shingles before applying new ones. Along with the old shingles, the roofing nails must be completely removed, because if they are sheared off, they would damage the new roofing and allow water to leak through. To remove shingles manually by a shovel, hammer or crowbar is a tiresome, difficult and slow operation and is expensive at today's labor, insurance and overhead costs.

My invention is designed to be used by an unskilled laborer and greatly increases the speed of the operation by markedly increasing the mechanical advantage and resultant leverage that can be applied to the shingles and nails. It can be safely used on roofs of any pitch in all directions and removes the nails without shearing. It leaves the roof deck clear and ready to install appropriate roofing material. The apparatus is lightweight, simple to operate, compact, portable, easy to control and will not run away from the operator at any height. It is uncomplicated with few parts, is durable and easy to maintain or repair. Auxiliary equipment such as an air compressor, electric power source or compressed gas supply are readily available. The cost of the apparatus is reasonable, can be amortized quickly and will more than pay for itself in labor savings. It exerts substantial leverage, sufficient to remove many layers of shingles.

My invention is a significant advance over manually operated equipment which rely on the strength of the laborer to do the job and it can be used in any bodily position.

It is also a substantial step forward over power driven, continuously operating rotary or reciprocating equipment which is not easily controlled because of its bulk, weight, momentum and inertia. These machines tend to shear nails off without pulling them out completely, might not clear up a roof properly, leading to possible defacing, marring or damaging the roofing surface and also necessitating further manual cleanup in which pieces of the shingles have to be removed along with nail bodies left in the roof. In addition, this equipment can be noisy and vibratory and this combined with its momentum can have a harmful effect on the roof support structure. At the fast speed of this machinery, where control is not as exact as with my apparatus, there is a potential for safety hazards high off the ground which might lead to injury to the operator or people below. Since my apparatus may be used in any direction, it is not limited to working in certain pathways which might be unsafe, particularly those which traverse to the edge of a roof. These machines need special transportation, whereas my apparatus can be easily carried by hand or transported by any vehicle.

SUMMARY OF THE INVENTION

A primary object of this invention is to fill a long felt need for a novel apparatus using a new technique which is simple to operate and greatly increases the rate of easily and completely removing shingles and roofing nails from a building roof of any pitch in a uniformly constant manner, thus saving a substantial amount of labor and expenses.

A further object is to provide a novel, improved and easily controlled power operated apparatus which can be used by unskilled laborers in any bodily position and which is safe to operate, doesn't depend on the strength of the operator, eliminates much of the boring and monotonous drudgery of this work and will not lead to slow down of the work due to weariness.

Another object is to provide an apparatus which can be controlled to respond quickly to the operator, will not run out of control, and which is safe to operate on the roofs of any slope at various heights.

A notable object is to provide an apparatus to speed up the process, eliminate superfluous workers on the roof which might lead to overloading and damage to roof supports, and make the job site more secure.

An additional object is to provide an apparatus which is portable, lightweight, compact, reliable, easy to handle by one person and does not tax the strength of the operator.

An important object is to provide an apparatus of mechanically simple, durable construction which can be economically produced and marketed to satisfy a significant demand and whose substantial leverage can remove many layers of shingles.

Yet a further object of this invention is to provide a power driven apparatus which can quickly and efficiently remove roof shingles from building roofs in any direction without damaging, marring, or defacing the roofing surface and which can adequately sustain the significant stresses and strains accompanying its use. Accordingly, this apparatus has a powered means which drives a blade with a slotted forward edge down whereby it is inserted under the roofing shingles, after which the blade is driven up, thus exerting substantial leverage and detaching the shingles while the nail bodies are engaged by the slots in the blade and the nails are pulled out, after which the apparatus is rocked in a forward direction and the shingles with the nails attached are stripped by the blade and accumulated and pushed off the roof or stacked in a pile, and the process is repeated.

This apparatus has additional uses comprising, but not limited to, removal of wall siding, wall shingles, wall shakes, floor tiles, flooring, gutters and leaders, and the disassembly of building members such as walls, ceilings, flooring and roof framing. It can also be used for digging ditches and has many other applications where prying and lifting is necessary on flat or sloping surfaces. The speed of the operation and the travel of the blade may be varied consistent with the job to be done.

Other objects of my invention as well as accompanying novel features will appear in the contents of the following description and recited in the claims.

BRIEF DESCRIPTION OF THE DRAWINGS

The accompanying drawings form a part of the specification and are to be read in conjunction therewith, and in which like reference numbers are used to indicate like parts in the various views, according to the preferred embodiment, utilizing the method as described herein:

FIG. 7 is a plan view of the apparatus substituting an air motor coupled to a linear actuator for compressed air activating an air cylinder.

FIG. 8 is a plan view of the apparatus substituting an electric motor coupled to a linear actuator for compressed air activating an air cylinder.

FIG. 9 is a plan view of the apparatus substituting hydraulic fluid under pressure energizing a hydraulic cylinder for compressed air activating an air cylinder. The blade 6 has the optional extensions shown in FIG. 6.

DESCRIPTION OF THE PREFERRED EMBODIMENT

Figure 1:
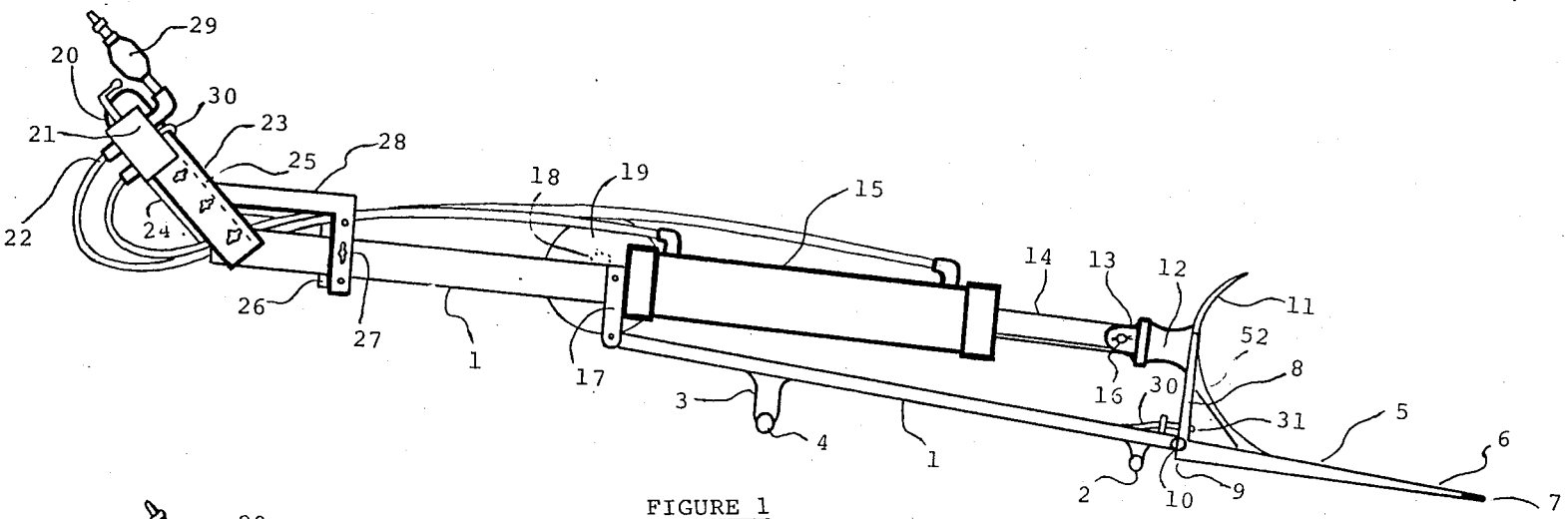
FIG. 1 is an elevation view of my invention, POWERED ROOF SHINDLE DETACHER AND STRIPPER APPARATUS at the start of the processing cycle when the blade is down and ready to be inserted under the shingles.

To promote an understanding of the principles of the invention, I refer to the embodiment shown in the drawings and to the particular language employed in the description with no intent to limit the range of the invention. This includes any modification of the portrayed apparatus and any further changes or applications of the basis of the invention as shown therein being normally considered to the skilled in the art related to this invention.

FIG. 1 is an elevation of my invention, POWERED ROOF SHINGLE DETACHER AND STRIPPER APPARATUS, at the start of the processing cycle, according to the preferred embodiment using the method described here. A frame 1 is shown on which components and their supporting members are located. A rolling means in the form of front wheels 2 on the front part of the frame 1 makes the apparatus easy to move. A fulcrum means in the form of a bracket 3 under a middle part of the frame 1 enables the apparatus to be rocked and increases the mechanical advantage. This also includes a rolling means in the form of rear wheels 4. In both instances, the front wheels 2 and the rear wheels 4 could be replaced by, but not limited to, a bar, rod or tube which can rotate. A shovel-like device 5 comprising a blade 6, with a plurality of nail body engaging slots 7 at the front end, which is flat to turned up relative to a rear section 8, is located at the front part of the frame 1. The plane of the blade at the front end may be straight or angled downward and its shape may be square, curved or angular. The slots may be square or may be angular with a narrowing apex so that the nails will bind and be pulled out without shearing. A pivot 9 is constructed of a cylindrical or triangular base connected to the bottom of the shovellike device 5 at the junction where the blade 6 and the rear section 8 meet and through which a pivot shaft 10 is passed and anchored to the frame 1 to enable the blade 6 to move down to be inserted under the shingles and to move up to raise and detach them while engaging and pulling out nails. An arm 11 attached to the rear section 8 accumulates the shingles and pushes them off the roof or stacks them. A brace 52, attached to the blade 6 and the rear section 8, strengthens the assembly and guides the shingles to the arm 11. A handle 12 joined to the rear section 8 attaches to an end mount 13 of a cylinder shaft 14 at one end of an air cylinder 15 by an unfixed pin assembly 16 which allows the handle 12 and the air cylinder 15 to move at varying angles to each other. The air cylinder 15 is attached to a fixed hinge 17 at the other end. A front grip 18 and a guard 19 attached to the middle of the frame 1 can be grasped with one hand to manipulate the apparatus in concert with a rear grip 20 attached to the rear of the frame 1 which can be grasped with the other hand. A control mechanism in the form of an air valve 21 mounted on the rear grip 20 uses compressed air as a power medium to activate the air cylinder 15.

The air valve 21, the rear grip 20, the front grip 18 and the guard 19 are extended to a plurality of locations at various angles relative to the frame 1 to accommodate various pitches of the roof, different bodily positions of operation and also to change the amount of leverage exerted. Extending the rear grip 20 location is done at the desired position by aligning one of a plurality of holes in a right bar 23 attached to the right side of the rear grip 20 with one of a plurality of holes in a right strut 24 which is next to and inside of the right bar 23 and which is attached to the right side of the frame 1. Each hole is spaced sequentially farther away from the frame 1 than the preceding one. When the desired position is achieved by moving the right bar 23 past the right strut 24, they are connected by a fastener through the aligned holes. This procedure is done simultaneously and in the same way with a left bar 25 and a left strut 26. To vary the angle of the rear grip 20 relative to the frame 1, a right pivot pin 27 at the base of the right strut 24 allows the right strut 24, the right bar 23 and the rear grip 20 to swing frontally and rearwardly. One of a plurality of holes in a right L-shaped bracket 28 joined to the right strut 24 is aligned with one of a plurality of holes in the frame 1. Once the proper angle has been achieved, a fastener connects both together through the aligned holes. This procedure may also be followed in the same way on the left side of the frame 1. In a like manner, the front grip 18 and the guard 19 may be extended and angled relative to the frame 1.

Compressed air can be replaced by other compressed gases which include, but are not limited to, nitrogen, carbon dioxide or one sold under the trademark FREON which, for safety's sake, should be inert, nontoxic and non-flammable. A hose and fitting assembly 22 connects the air valve 21 to the air cylinder 15 and also connects the air valve 21, with an oiler 29 on its end, to a compressed gas source to power the apparatus. The air valve 21 includes, but is not limited to, a manual or solenoid of 2-way, 3-way or 4-way operation. The air cylinder 15 includes, but is not limited to, double acting and single acting with spring return models. In operation of the apparatus, to start the processing cycle, when the air valve 21 is in one setting, the cylinder shaft 14 within the air cylinder 15 is pushed out by air flow and acts on the handle 12 to push the blade 6 down around the pivot 9, ready to be inserted under the shingles. Then, when the blade 6 has been moved under the shingles, the air valve 21 is put in another setting and the cylinder shaft 14 is brought back to its original closed position within the air cylinder 15 by the air flow. This raises the blade 6 to exert leverage and detach the shingles while the slots in the blade 6 engage nail bodies, press against nail heads and pull out the nails. By varying the flow of air from the air valve 21, the air cylinder 15 can operate at various speeds allowing the blade 6 to be raised quickly or slowly depending on the job requirements. A tube 30 is attached on one end to the exhaust port of the air valve 21 and the other end, with a jet nozzle 31 connected, is located at the front part of the frame 1 and pointed at the shingles to clean the area of roofing paper, loose shingles, nails and debris, using exhaust air from the air cylinder 15. As the apparatus is rocked in a forward direction, the shingles, with the nails attached, are stripped by the blade 6 and accumulated and pushed off the roof or stacked in a pile by the arm 11. The stroke on the air cylinder 15 may be varied to allow for different heights of travel for the blade 6 depending on the job requirements.

Figure 2:
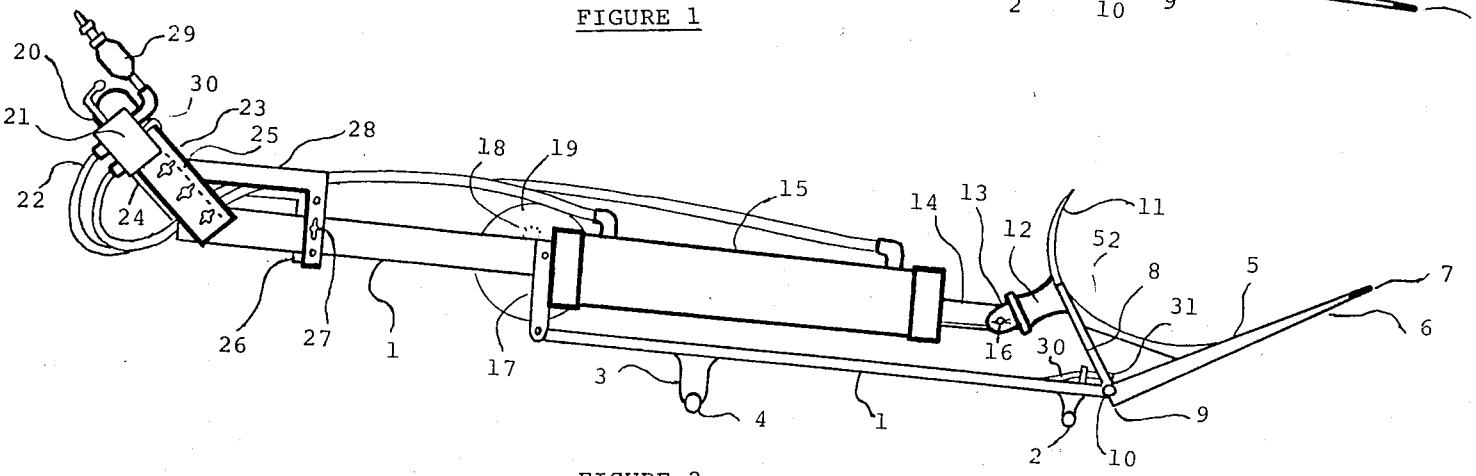
FIG. 2 is an elevation view of the apparatus in which the blade is in the raised position after having detached the shingles and pulled the nails from the roof.

FIG. 2 depicts an elevation of the apparatus in which the blade 6 is in the raised position after having detached the shingles and pulled the nails from the roof. This is accomplished by putting the air valve 21 in a setting which causes the air flow in the air cylinder 15 to retract the cylinder shaft 14, resulting in bringing the handle 12 down and thus raising the blade 6 around the pivot 9.

Figure 3:
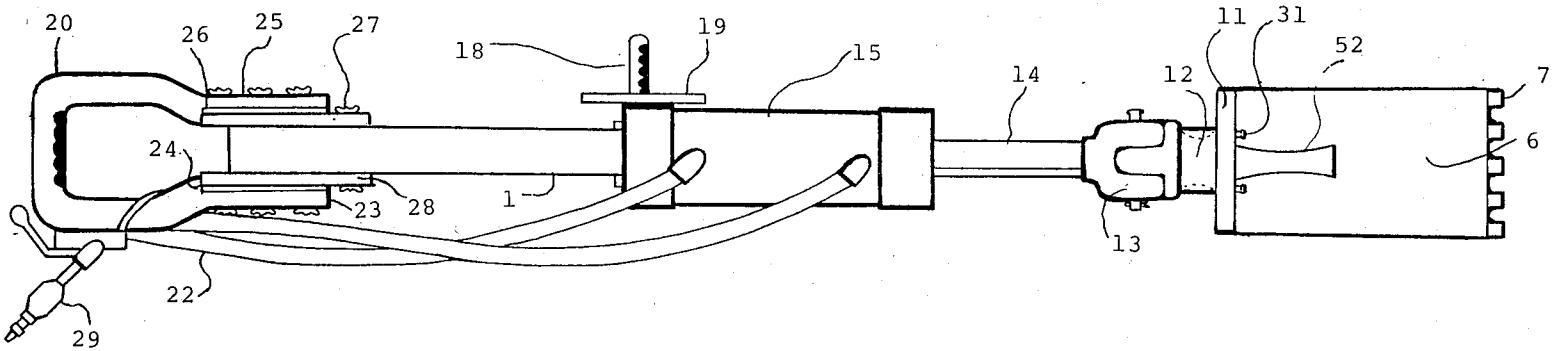
FIG. 3 is a plan view of the apparatus equivalent to the elevation view depicted in FIG. 1 in which the blade is in the lowered position.

FIG. 3 depicts a plan of the apparatus equivalent to the elevation depicted in FIG. 1 in which the blade 6 is in a lowered position and the air cylinder 15 is in the extended position.

Figure 4:
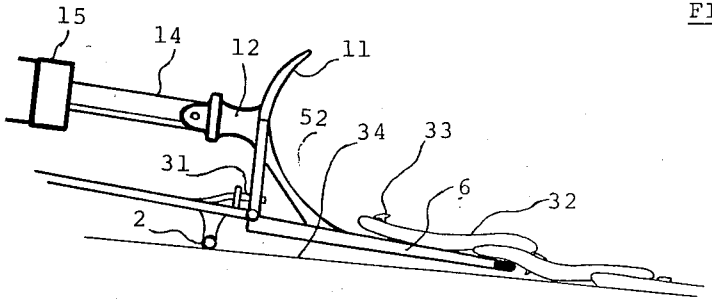
FIG. 4 is an elevation view of the apparatus with the blade in the lowered position and inserted under the shingles and nails on a sloping roof.

FIG. 4 depicts an elevation of the apparatus with the blade 6 in the lowered position and inserted under the shingles 32 and nails 33 on a sloping roof 34.

Figure 5:
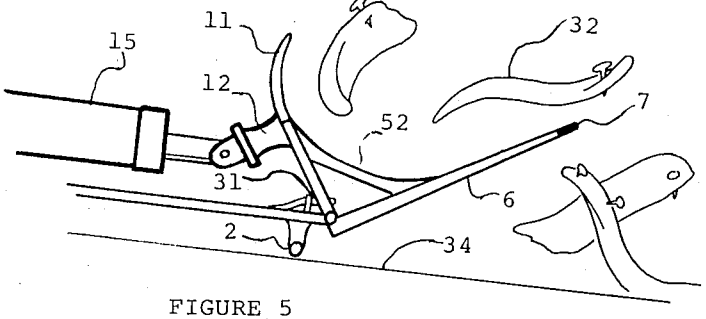
FIG. 5 is an elevation view of the apparatus with the blade raised after having detached the shingles and pulled out the nails on a sloping roof.

FIG. 5 depicts an elevation of the apparatus with the blade 6 raised after having detached the shingles 32 and pulled out the nails 33 on a sloping roof 34.

Figure 6:
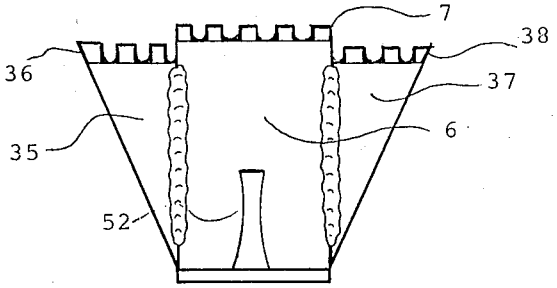
FIG. 6 is a plan view of the blade with extensions added to enable the apparatus to cover more area with each application

FIG. 6 depicts a plan of the blade 6 with slots 7 showing a left triangular extension 35 with left extended slots 36 and a right triangular extension 37 with right extended slots 38 to enable the apparatus to effectively cover more area with each application. The extensions may be square, curved or angular.

FIG. 7 depicts a plan sight of the apparatus substituting parts which connect to the handle 12 and drive the blade 6 but keep the operation the same, using compressed air supplied through an inlet hose assembly 39 to an air controller 40 which governs the flow to an air motor 41 coupled to a linear actuator 42. The linear actuator 42 includes, but is not limited to, a container with a reciprocating shaft which is driven by either a gear or a cam. The inlet hose assembly 39 replaces the hose and fitting assembly 22 in FIG. 1 and connects the air controller 40 to the air motor 41 and also connects the air controller 40 to a compressed gas source to power the apparatus. The air controller 40 replaces the air valve 21 in FIG. 1 and is mounted the same. The linear actuator 42 replaces the air cylinder 15 in FIG. 1 and is connected the same way. The operation is similar to that using the air cylinder 15 in FIG. 1. When the air controller 40 is set in the open position, compressed air flows in and runs the air motor 41 which drives the linear actuator 42 and pushes out its actuator shaft 43, which is joined to the handle 12, to its extended position, thus lowering the blade 6. At the same time, the air controller 40 is set in the closed position, cutting off the air supply and stopping the actuator shaft 43 from moving while the blade 6 is inserted under the shingles. The air controller 40 is then set in the open position and the actuator shaft 43 retracts to its closed position, thus raising the blade 6 to detach the shingles and pull out the nails. The air controller 40 includes, but is not limited to, a manual or solenoid air valve or an air cock.

FIG. 8 depicts a plan-sight of the apparatus substituting parts which connect to the handle 12 and drive the blade 6 but keep the operation the same, using electricity to power the apparatus, supplied to an electrical switch 44 which governs the supply to an electric motor 45 coupled to a linear actuator 46. The electrical switch 44 replaces the air valve 21 in FIG. 1 and is mounted the same. The linear actuator 46 replaces the air cylinder 15 in FIG. 1 and is connected the same way. The linear actuator 46 includes, but is not limited to, a container with a reciprocating shaft which is driven by either a gear or a cam. The operation is similar to that using the air cylinder 15 in FIG. 1. When the electrical switch 44 is turned on, electricity flows in and runs the electric motor 45 by electrical wiring 47 which connects them. This drives the linear actuator 46 and pushes out the actuator shaft 48, which is joined to the handle 12, to its extended position, thus lowering the blade 6. At the same time the electrical switch 44 is turned off, cutting off the electrical supply and stopping the actuator shaft 48 from moving while the blade 6 is inserted under the shingles. The electrical switch 44 is then turned on and the actuator shaft 48 retracts to its closed position, thus raising the blade 6 to detach the shingles and pull out the nails.

FIG. 9 depicts a plan of the apparatus substituting parts which connect to the handle 12 and drive the blade 6 but keep the operation the same, using hydraulic fluid pumped from a source to a hydraulic valve 49 which governs the flow to a hydraulic cylinder 50 through a hydraulic hose assembly 51. The hydraulic hose assembly 51 replaces the hose and fitting assembly 22 in FIG. 1 and connects the hydraulic valve 49, which replaces the air valve 21 in FIG. 1, to the hydraulic cylinder 50, which replaces the air cylinder 15 in FIG. 1 and is attached the same way. The operation is the same as that using the air cylinder 15 in FIG. 1, except that hydraulic fluid under pressure has replaced compressed air. The blade 6 has the optional extensions as in FIG. 6.

The power means to drive the blade up and down may comprise, but not be limited to, compressed gas, hydraulic fluid under pressure, electricity and fuel. The power generating mechanism may comprise, but not be limited to, an electric motor, air motor or fuel operated engine. The power transfer medium, which is connected to the handle on one end and to the power generating mechanism on the other end, may selectively be paired with one of the power generating mechanisms and may comprise, but not be limited to, a cylinder, a linear actuator, a cam or a reciprocating shaft. When a cylinder is employed as the power transfer medium and either compressed gas or hydraulic fluid under pressure is used as the power means, no power generating mechanism is utilized. The stroke on the power transfer mediums may be varied to allow for different heights of travel for the blade 6 depending on the job requirements. If compressed gas is not used as the power means, a separate source of compressed gas may be used to activate the jet nozzle 31 in FIG. 1.

My invention has additional uses comprising, but not limited to, removal of wall siding, wall shingles, wall shakes, floor tiles, flooring, gutters and leaders, and the disassembly of building members such as walls, ceilings, flooring and roof framing. It can also be utilized for ditch digging and for many other applications where prying and lifting is necessary on flat or sloping surfaces.

What is claimed is:

1. A powered roof shingle detacher and stripper apparatus, comprising;

(a) a frame;

(b) a rolling means under a front part of the frame to make the apparatus easy to move;

(c) a fulcrum means under a middle part of the frame to enable the apparatus to be rocked and to increase the mechanical advantage to detach the shingles and which also includes a rolling means;

(d) a shovel-like device comprising a blade located at the front part of the frame with a plurality of nail body engaging slots at the front end, wherein the blade is flat to turned up relative to a rear section;

(e) a pivot beneath the junction where the blade and the rear section meet to enable the blade to move down to properly position said blade for insertion under the shingles and to move up to raise and detach the shingles while engaging and pulling out nails;

(f) an arm attached to the rear section which accumulates the shingles after stripping and pushes them off a roof or stacks them in a pile;

(g) a handle joined to the rear section which attaches to an end mount of a cylinder shaft at one end of a gas cylinder by an unfixed pin assembly which allows the handle and the gas cylinder to move at varying angles to each other, said gas cylinder attached to a hinge fixed to the frame at the other end;

(h) a front grip and a guard attached to the middle of the frame which can be grasped with one hand to manipulate the apparatus in concert with a rear grip attached to the rear of the frame which can be grasped with the other hand;

(i) a control mechanism mounted on the rear grip which uses compressed gas as a power medium to activate the gas cylinder, wherein the control mechanism, the rear grip, the front grip, and the guard are extended to a plurality of locations at various angles relative to the frame to accommodate various pitches of the roof, different bodily positions of operation and also to change the amount of leverage exerted;

(j) a hose and fitting assembly which connects the control mechanism to the gas cylinder and which also connects the control mechanism to a compressed gas source to power the apparatus, wherein, when the control mechanism is in one setting, the cylinder shaft within the gas cylinder is pushed out by gas flow and acts on the handle to push the blade down, ready to be inserted under the shingles, and when the blade is moved under the shingles, the control mechanism is put in another setting and the cylinder shaft is brought back to its original closed position within the gas cylinder by the gas flow, thus raising the blade to exert leverage and to detach the shingles while the slots in the blade engage nail bodies and press upward against nail heads and pull out nails, and as the apparatus is rocked in a forward direction, the shingles with the nails attached are stripped by the blade and accumulated and pushed off the roof or stacked in a pile by the arm.

2. A powered roof shingle detacher and stripper apparatus as described in claim 1, wherein a tube is attached on one end to the control mechanism and the other end, with a jet nozzle connected, is located at the front part of the frame, and pointed at the shingles to clear the area of roofing paper, loose shingles, nails and debris using exhaust gas from the gas cylinder.

3. A powered roof shingle detacher and stripper apparatus as described in claim 1, wherein, by combination, the control mechanism comprises a four-way valve and the gas cylinder is double-acting.

4. A powered roof shingle detacher and stripper apparatus, as described in claim 1, wherein, by combination, the control mechanism comprises a two-way valve and the gas cylinder is single--acting with a spring return.

5. A powered roof shingle detacher and stripper apparatus, as described in claim 1, wherein the front blade is extended on each side by pieces slotted on the front end to enable the apparatus to effectively cover more area with each application.

6. A powered roof shingle detacher and stripper apparatus, as described in claim 1, wherein compressed gas is used to power a gas motor and a linear actuator is used instead of a gas cylinder.

7. A powered roof shingle detacher and stripper apparatus, as described in claim 1, wherein the compressed gas is air.

8. A powered roof shingle detacher and stripper apparatus, as described in claim 1, wherein the power medium is hydraulic fluid.

9. A powered roof shingle detacher and stripper apparatus, as described in claim 1, wherein electricity is used to power an electric motor, the control mechanism is an electrical switch and a linear actuator is used instead of a gas cylinder.

* * * * *